United States Patent [19]

Brown

[11] Patent Number: 4,782,603

[45] Date of Patent: Nov. 8, 1988

[54] MIDSOLE

[75] Inventor: Stephen C. Brown, San Francisco, Calif.

[73] Assignee: The Summa Group Limited, San Francisco, Calif.

[21] Appl. No.: 895,766

[22] Filed: Aug. 12, 1986

[51] Int. Cl.[4] ..... A43B 13/20; A43B 13/18

[52] U.S. Cl. ..... 36/29; 36/28

[58] Field of Search ..... 36/28, 29, 30 R, 25 R, 36/31, 27, 102, 103, 107, 108, 114, 3 B, 92

[56] References Cited

U.S. PATENT DOCUMENTS

| | | | |
|---|---|---|---|
| 2,100,492 | 11/1937 | Sindler | 36/29 |
| 4,271,606 | 6/1981 | Rudy | 36/29 |
| 4,507,879 | 4/1985 | Dassler | 36/28 |
| 4,593,482 | 6/1986 | Mayer | 36/28 |

FOREIGN PATENT DOCUMENTS

| | | | |
|---|---|---|---|
| 958766 | 9/1949 | France | 36/28 |
| 1310482 | 10/1962 | France | 36/3 R |
| 291599 | 12/1931 | Italy | 36/3 B |
| 483807 | 2/1970 | Switzerland | 36/29 |

*Primary Examiner*—Steven N. Meyers

*Attorney, Agent, or Firm*—Townsend and Townsend

[57] ABSTRACT

A molded midsole encapsulating a series of parallel, spaced-apart tubes for shock absorption. The tubes are disposed perpendicular to the longitudinal axis of the sole. The tubes are constructed from a material somewhat more rigid than the surrounding molded material. The tubes may be arranged in the forefoot region, or in the heel region, or throughout the longitudinal span of the midsole. Transverse strips of tubing material may be used to space apart and join tubes to fabricate separate tube assemblies which are inserted directly in the midsole mold.

7 Claims, 1 Drawing Sheet

MIDSOLE

BACKGROUND OF THE INVENTION

The present invention relates to an improved shoe midsole.

A number of midsole and outsole designs have been proposed to improve the shock absorption of shoes, especially athletic shoes. Various shaped outsoles, which are the sole portions which actually contact the ground, have been proposed to provide shock absorption features. Some designs have also proposed embedding liquid filled vessels in the midsole, which is the portion of the shoe between the upper of the shoe and the outsole. Other designs have proposed inserting removable cylinders of varying densities into the midsole to provide an adjustable level of shock absorption.

SUMMARY OF THE INVENTION

The present invention is drawn to a midsole which has a forefoot region and a heel region, and which is molded from a flexible, resilient material. The midsole has a sole axis which extends from the heel of the shoe to the toe. A plurality of tubes, are embedded in the molded midsole. The tubes may be spaced in the forefoot region alone, the heel region alone or throughout the midsole, depending on the application for which the shoe is intended. The tubes each have a tube axis, and are arranged in parallel, spaced apart relation along the midsole with their tube axes generally perpendicular to the sole axis.

One of the many advantages of the invention is its simplicity of construction. It is inexpensive to manufacture, yet equally as effective a shock absorption system as the more complicated structures.

DETAILED DESCRIPTION OF THE PREFERRED EMBODIMENT

Figure 1:
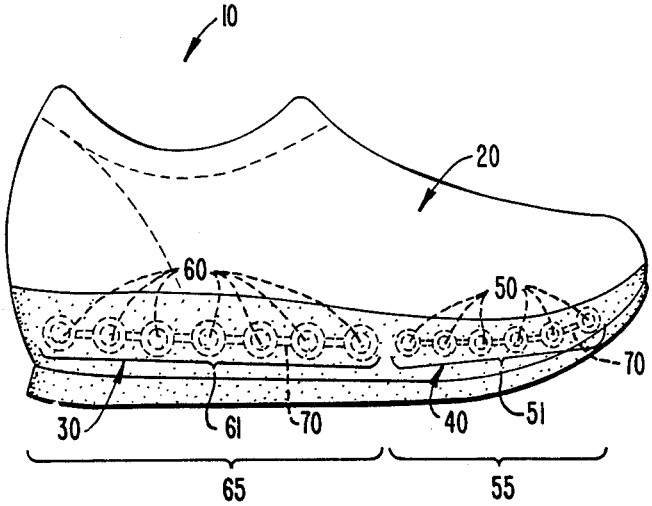
FIG. 1 is a side elevational view of a shoe midsole embodying the present invention.

Referring to FIG. 1, a simplified schematic of a shoe 10 is shown with an upper 20, a midsole 30, and an outsole 40. The midsole 30 is formed with an assembly 50 of six smaller diameter tubes disposed in the front, or forefoot region 55 of the shoe, and an assembly 60 of seven larger diameter tubes disposed in the rear, or heel region 65 of the shoe.

It is to be understood that the preferred embodiment described herein is directed to a shoe with tube assemblies in both the forefoot region 55 and heel region 65. Certain shoes designed for certain activities would have tube assemblies disposed in either the forefoot region alone or the heel region alone. For instance, for aerobic exercise shoes, the tubes would only be in the forefoot region 55 of the shoe. For running shoes, basketball shoes, walking shoes or tennis shoes, tubes only in heel region 65 would be more appropriate.

Midsole 30 partially comprises a midsole element which is molded from polyurethane, which is the chosen material of construction because it is flexible, moldable and resilient. The midsole is fixedly attached to the upper 20 and outsole 40 in a conventional fashion known to those skilled in the art. The assemblies 50, 60 are suspended in the mold prior to the injection or introduction of the molten midsole polyurethane material. Tube assemblies 50, 60 are also constructed from nitrile butadiene or another rubber base compound and must be more dense than the material used for the midsole to withstand repeated impact forces.

Figure 2:
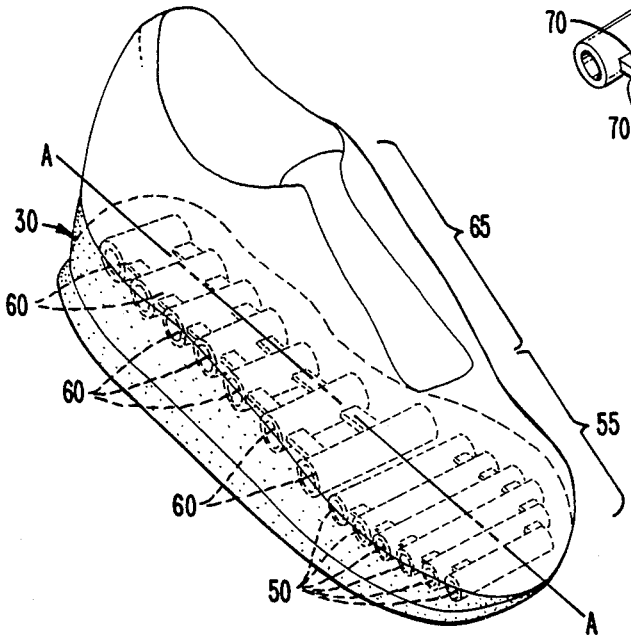
FIG. 2 is an isometric view of a shoe with the tube arrangement of the present invention.

FIG. 2 is an isometric view of a shoe containing tube assemblies 50 and 60, illustrating the relation of tube assemblies 50, 60 to the longitudinal sole axis represented by the line A—A. Each tube has a tube axis which is generally perpendicular to sole axis A—A. The tube assemblies 50 in the forefoot region 55 must be arranged transverse to the sole axis A—A, since it would detract from the flexibility of the front portion of the shoe if they had a longitudinal arrangement.

Tube assembly 60 in heel region 65 might also be arranged in a longitudinal arrangement since there is little flexure of the sole in the heel region 65. However, the transverse arrangement is preferred in heel region 65 also, since it is easier to suspend tube assemblies 60 during the molding of midsole 30.

To facilitate the manufacture of the midsoles of the present invention, forefoot tube assemblies 50 and heel tube assemblies 60 may be produced as integral units 51 prior to the molding step of the midsole. For instance, the six forefoot tubes of tube assembly 50 shown in FIGS. 1 and 2 could be produced at the same time and connected near their ends by short, transverse strips 70 constructed from the same tube material. The transverse strips 70 also serve to space apart the individual tubes of tube assemblies 50 or 60 a predetermined distance. The assembly of forefoot tubes 50 could then be placed as an integral unit into the forefoot region of the midsole mold during the midsole manufacturing process. A similar method could be used to produce tube assembly tubes 60. The individual tubes ends could be sealed in an additional step. This method of producing tube assemblies would save labor in the molding of the midsole by eliminating the process of cutting individual tubes to length and having to position individual tube segments within the mold.

During vigorous exercise, such as running, tennis or other activities, the heel may be the first portion of the shoe to strike the ground. To absorb the greater impact loads imposed on the heel, a greater number of tubes 60 are spaced along heel region 65. To provide the greater cushioning effect, and also to compensate for the greater thickness of the midsole in heel region 65, larger diameter tubes are used in heel region 65 of the midsole. Smaller diameter tubes are used in forefoot region 55 to dissipate the impact forces away from the foot and leg of the wearer.

The tubes 50, 60 themselves must be constructed from a material which is somewhat more dense than the polyurethane or other resilient material used to mold the remainder of the midsole. Because of the number of impacts which are imparted to the tubes, the tubes must be of sufficient resiliency and strength to resist collapse along their walls. The tubes must resist such impact forces for the lifetime of the shoe in order to provide for continued shock absorption. The tubes 50, 60 should be of sufficient hardness so as to remain in their undeformed state under the weight of the wearer. Tubes 50, 60 should only be deformed under impact loads. The density of the tubing material may be varied according to the application for which the shoe is designed.

Figure 3:
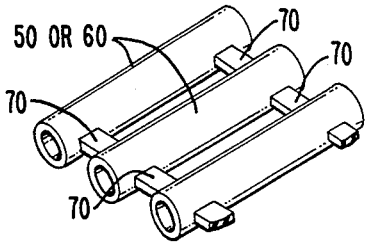
FIG. 3 is a detailed isometric view of transverse strips between tubes.

The spacing between individual tubes in heel region 65 and forefoot region 55 determine the flexibility and "give" of the midsole. This spacing is partly defined by strips 70 as shown in the detail of FIG. 3. It has been found that a spacing of between three and four millimeters between tubes is best for athletic shoes. Tubes 60 having an outer diameter of about six millimeters and an inner diameter of about four millimeters have been tested and found to be satisfactory. Tubes 50 having an outer diameter of four to five millimeters and an inner diameter of two to three millimeters have also been found satisfactory.

In constructing the midsole, it has been found that it is preferable to completely encapsulate the tubes 50, 60, rather than leaving the ends exposed along the sides of the shoe. This results in ambient air being trapped within the tubes during the molding process, with the resulting pressure providing an enhanced rigidity to the tubes. Further, encapsulation of the tubes prevents debris from collecting inside of the tubes. Such debris might interfere with the proper deformation of the tubes 50, 60 during loading.

The foregoing is a complete description of the invention. The above is not intended to limit the scope of the invention disclosed herein. For instance, the number or dimensions of the tubes in the detailed description could be altered without departing from the present invention. Other modifications and variations can be made to the disclosed embodiments without departing from the subject of the invention as defined in the following claims.

What is claimed is:

1. A midsole for a shoe, said shoe having a toe, a heel, an upper and an outsole, comprising:

a molded midsole element having embedded within it a forefoot tube assembly and a heel tube assembly;

said midsole element being characterized by a sole axis extending from said heel to said toe; and wherein said forefoot tube assembly and said heel tube assembly further comprise a plurality of tubes in parallel arrangement, each tube sealed at both ends, each tube having a longitudinal tube axis, said tubes maintained in a diametrically spaced apart relation by spacing means integrally formed as part of each tube assembly, with said tube axes generally perpendicular to said sole axis, said midsole element sandwiched between said upper and said outsole.

2. The midsole of claim 1, wherein said tubes are constructed from a material which is more dense than the material from which said forefoot region and said heel region are constructed.

3. The midsole of claim 1, wherein said tubes in said heel tube assembly have a greater outer diameter than said tubes in said forefoot tube assembly.

4. The midsole of claim 1, wherein said tubes in said forefoot tube assembly have an outer diameter of four millimeters and an inner diameter of two millimeters.

5. The midsole of claim 4, wherein said tubes in said forefoot tube assembly are spaced apart three millimeters.

6. The midsole of claim 1, wherein said tubes in said heel tube assembly have an outer diameter of six millimeters and an inner diameter of four millimeters.

7. The midsole of claim 6, wherein said tubes in said heel tube assembly are spaced apart three millimeters.

* * * * *